US006071385A

United States Patent [19]

Long

[11] Patent Number: 6,071,385

[45] Date of Patent: Jun. 6, 2000

[54] RACKING FIXTURE FOR ELECTROCHEMICAL PROCESSING

[75] Inventor: Earl R. Long, Seattle, Wash.

[73] Assignee: The Boeing Company, Seattle, Wash.

[21] Appl. No.: 09/164,225

[22] Filed: Sep. 30, 1998

Related U.S. Application Data

[60] Provisional application No. 60/064,225, Nov. 4, 1997.

[51] Int. Cl.[7] ..... C25D 17/00; C25D 17/04; C25B 15/00; C25B 9/00; C25B 11/04

[52] U.S. Cl. ..... 204/222; 204/230.7; 204/267; 204/279; 204/292; 204/293; 204/297 W

[58] Field of Search ..... 204/222, 279, 204/267, 297 R, 297 W, 224 R, 292, 294, 293, 230.7

[56] References Cited

U.S. PATENT DOCUMENTS

| | | | |
|---|---|---|---|
| 2,746,732 | 5/1956 | Guillette | 204/222 X |
| 3,256,171 | 6/1966 | Gualdieri, Sr. et al. | 204/297 W X |
| 3,271,290 | 9/1966 | Pianowski | 204/222 |
| 3,796,646 | 3/1974 | Zambon | 204/222 |
| 3,804,732 | 4/1974 | Goodkin | 204/222 X |
| 4,268,206 | 5/1981 | Johnson . | |
| 4,560,592 | 12/1985 | Friedland . | |
| 4,911,818 | 3/1990 | Kikuchi et al. . | |
| 5,067,431 | 11/1991 | Heitmiller . | |
| 5,077,099 | 12/1991 | Kukanskis et al. . | |
| 5,110,440 | 5/1992 | Case . | |
| 5,152,840 | 10/1992 | Ruehl . | |
| 5,224,994 | 7/1993 | Daly . | |
| 5,480,675 | 1/1996 | Murakami et al. . | |

*Primary Examiner*—Donald R. Valentine
*Attorney, Agent, or Firm*—Lawrence W. Nelson

[57] ABSTRACT

The present invention relates to a racking fixture for holding components while they are electro-chemically processed. The fixture includes at least one shelf for holding the components and is electrically connected to a bus bar. A motor is mechanically engaged with the shelf and causes it to agitate to remove gasses trapped in components held on the fixture. The fixture also includes localized anodes for positioning adjacent to specific portions of the component.

19 Claims, 6 Drawing Sheets

RACKING FIXTURE FOR ELECTROCHEMICAL PROCESSING

This application claims the benefit of U.S. provisional application Ser. No. 60/064,225, filed Nov. 4, 1997.

BACKGROUND OF THE INVENTION

1. Field of the Invention

The present invention relates to a fixture for holding components during electro-chemical processing and, more particularly, is directed to a racking fixture designed to ensure uniform electrochemical processing over all surfaces of a component.

2. Background Information

Metallic components critical to a mechanical operation are often electro-chemically treated to ensure their reliability. For example, components critical to the performance of an aircraft are coated with cadmium to protect the components from corrosion or other related damage caused by exposure to an extreme environment. Another example of electrochemical processing would be copper plating a component to prevent a build-up of carbon which would otherwise occur in a high temperature environment.

The electrochemical processing of a component to enhance its reliability is often a complex process. For example, to electroplate components with cadmium, they are first cleaned in an emulsion cleaner, such as Brulan 815 GD, and soap to remove all oil deposits. Then the components are double rinsed and cleaned in an alkaline cleaning solution, such as IsoPrep 44L-ND. The components are then double rinsed and treated with IsoPrep 172, where they undergo a "forward/reverse" treatment in which they are polarized first at one polarity and then in the opposite polarity. The forward/reverse treatment assists in removing any remaining unwanted deposits. The components are then rinsed again and immersed in a solution of hydrochloric acid to activate the metallic portions of the components. The activated metal of the components is then double rinsed again and finally dipped into a tank 200 containing cyanide, as shown in FIG. 1.

The tank 200 is typically electrically connected to a main rectifier 202, which produces approximately 1000 amps of current and 3 volts potential within the cyanide solution. The negative terminal of the rectifier 202 is coupled to negative terminal contacts 204*a* and 204*b*, while the positive terminal of the rectifier 202 is coupled to positive terminal contacts 206*a* and 206*b*. Extension positive buses 208*a* and 208*b* are placed lengthwise across the tank 200 to make contact with the respective positive terminal contacts 206*a* and 206*b*. Anode baskets 210*a*–210*f* are suspended from the positive buses 208*a* and 208*b* by conductive metal cables 211*a*–211*f* The anode baskets 210*a*–210*f* typically contain three or four cadmium balls.

A rack 212, including current transmitting support members (i.e. negative buses) 214*a*–214*e*, is seated upon the tank 200. The support members 214*a*–214*e* are physically, as well as electrically, connected to negative terminal contacts 204*a* and 204*b*. Two parallel projections 216*a* and 216*b* extend downward into the tank 200 from the support members 214*a*–214*e*. Two or more component-holding shelves 218*a* and 218*b* are positioned between the parallel projections 216*a* and 216*b* and supply a negative electric charge from the main rectifier 202 to each of the components supported within the rack 212.

Many of the components processed in this manner, such as component 220 in FIG. 2, have blind holes, i.e., holes which dead-end within the component 220. For example, in the component 220, holes 222*a* and 222*b* are both blind holes. Unfortunately, with the above-described process, hydrogen and oxygen gas generated during the electrochemical treatment form bubbles within the blind holes 222*a* preventing proper cleaning and deposition of electroplate or anodonic coatings. Further, because of the structure of the blind holes 222*a* and 222*b*, they also usually receive insufficient potential for proper electroplating. Consequently, the components 220 need to be further processed within a secondary electroplating device 223, shown in FIG. 3.

The secondary electroplating device 223 includes cathode holders 224*a*–224*f*, each having holes filled with cyanide solution and coupled to a negative terminal of a rectifier (not shown). Each of the blind major holes 222*a* of the components 220 are filled by hand with cyanide solution and the components 220 are positioned into a respective one of these cathode holders 224*a*–224*f* Then, a series of cadmium anodes 226*a*–226*f*, which are held in position by plate 227, are stuck into the holes 222*a* of the respective components 220. Current is then applied to each of the anodes 226*a*–226*f* to deposit the appropriate amount of cadmium into the holes 222*a*.

Unfortunately, the secondary electroplating process performed by the device 223 can only handle a small number of the components 220 at a time. Also, the process potentially exposes a worker to direct contact with a toxic cyanide solution. Thus, the present process requires an extensive number of man hours to perform and may be hazardous as well.

Consequently, in the art of electroplating and electrochemical processing, there is a need for a device or racking fixture which can uniformly electroplate a component having blind holes without the use of a secondary process.

SUMMARY OF THE INVENTION

According to one aspect, the present invention relates to a racking fixture for holding components while they are electro-chemically processed. The fixture includes at least one shelf for holding the components and is electrically connected to a bus bar. A motor is mechanically engaged with the shelf and causes it to agitate to remove gasses trapped in components held on the fixture. The fixture also includes localized anodes for positioning adjacent to specific portions of the component.

According to another aspect, the present invention relates to a racking fixture for holding components while they are electro-chemically processed. The fixture includes a plurality of bus bars for supplying electrical current to the components while they are electro-chemically processed, and a shelf for holding the components, which is electrically connected to at least one of the plurality of bus bars. The fixture also includes a drive assembly electrically powered by the plurality of bus bars and mechanically engaged with the shelf to agitate the shelf to remove gases trapped in the components.

According to yet another aspect, the present invention relates to a racking fixture for moving components while they are electro-chemically processed to prevent uneven deposits of electroplating material. The fixture includes component support means for engaging the components and applying voltage of a designated polarity to the components, and a drive means imparting a rocking motion to the component support means to remove gases contiguous with any surface of the components. The fixture further includes movable anodes and means for positioning anodes local to a selected portion of one or more of the components. The anode means has a polarity applied to the components by the component support means.

BRIEF DESCRIPTION OF THE DRAWINGS

These and other features, aspects, and advantages of the present invention will be better understood with regard to the following description, appended claims, and accompanying drawings. In the accompanying drawings, there is shown a present preferred embodiment of the invention, wherein like-referenced numerals are employed to designate like parts, wherein:

DETAILED DESCRIPTION OF THE PREFERRED EMBODIMENTS

Figure 1:
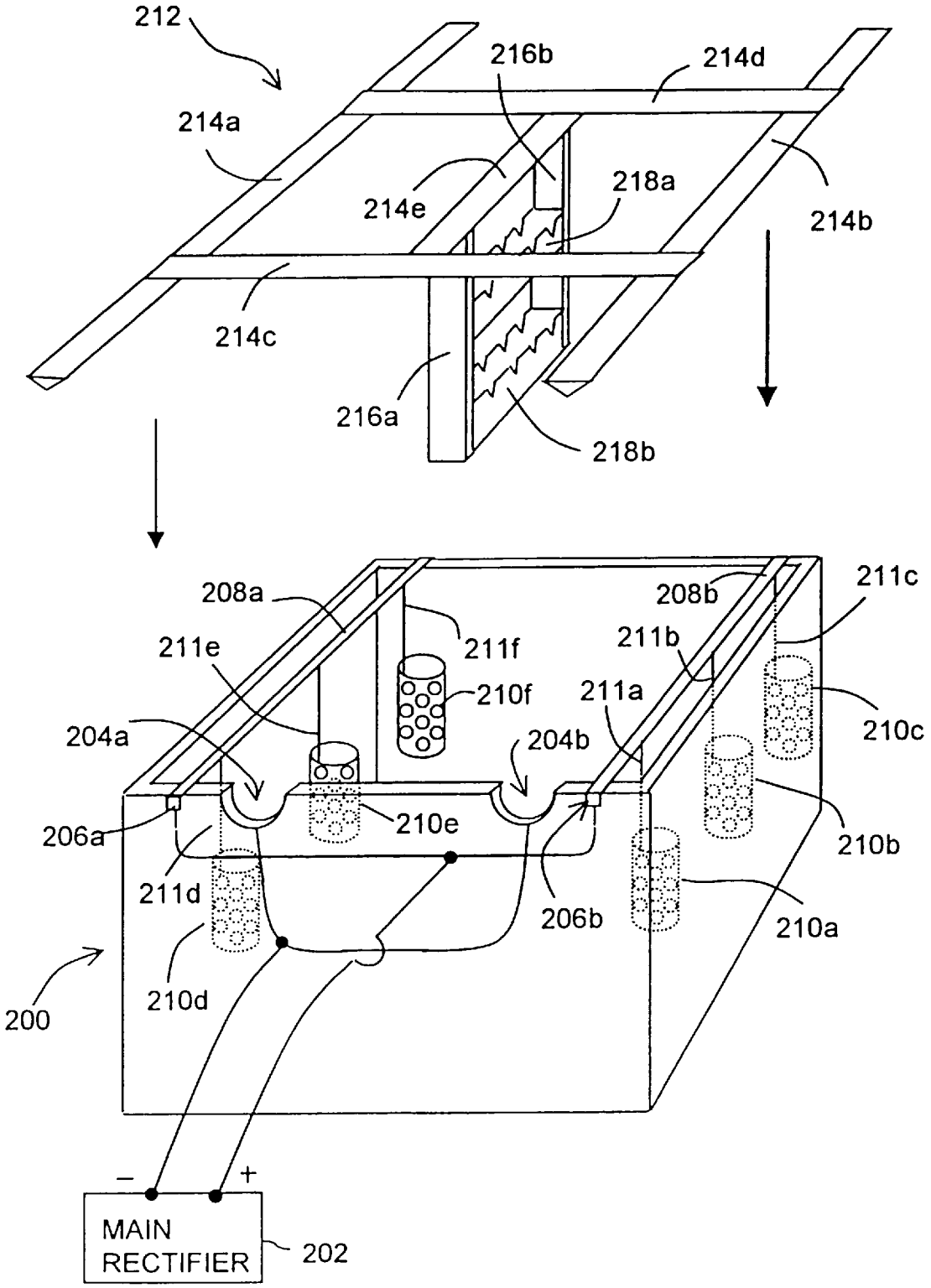
Fig. 1 (Prior Art)
FIG. 1 is an isometric view of a prior art chemical treatment tank.
Figure 2:
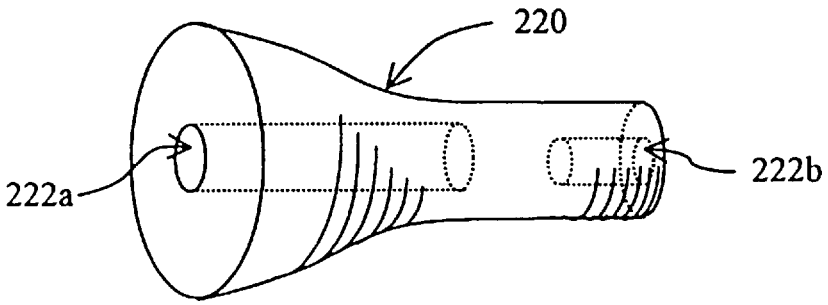
FIG. 2 is an isometric view of a component having blind-sided holes.
Figure 3:
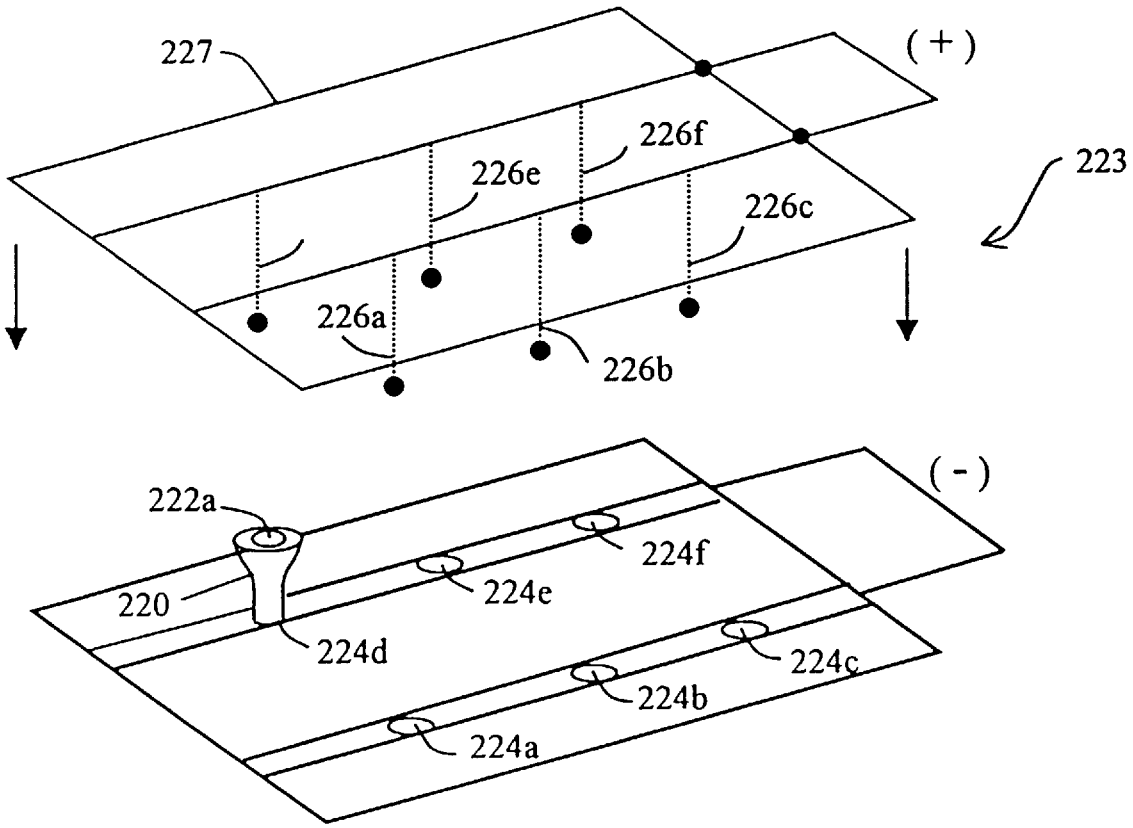
Fig. 3 (Prior Art)
FIG. 3 is an isometric view of a prior art secondary electroplating device used for electroplating the inside of a blind-sided hole.
Figure 4:
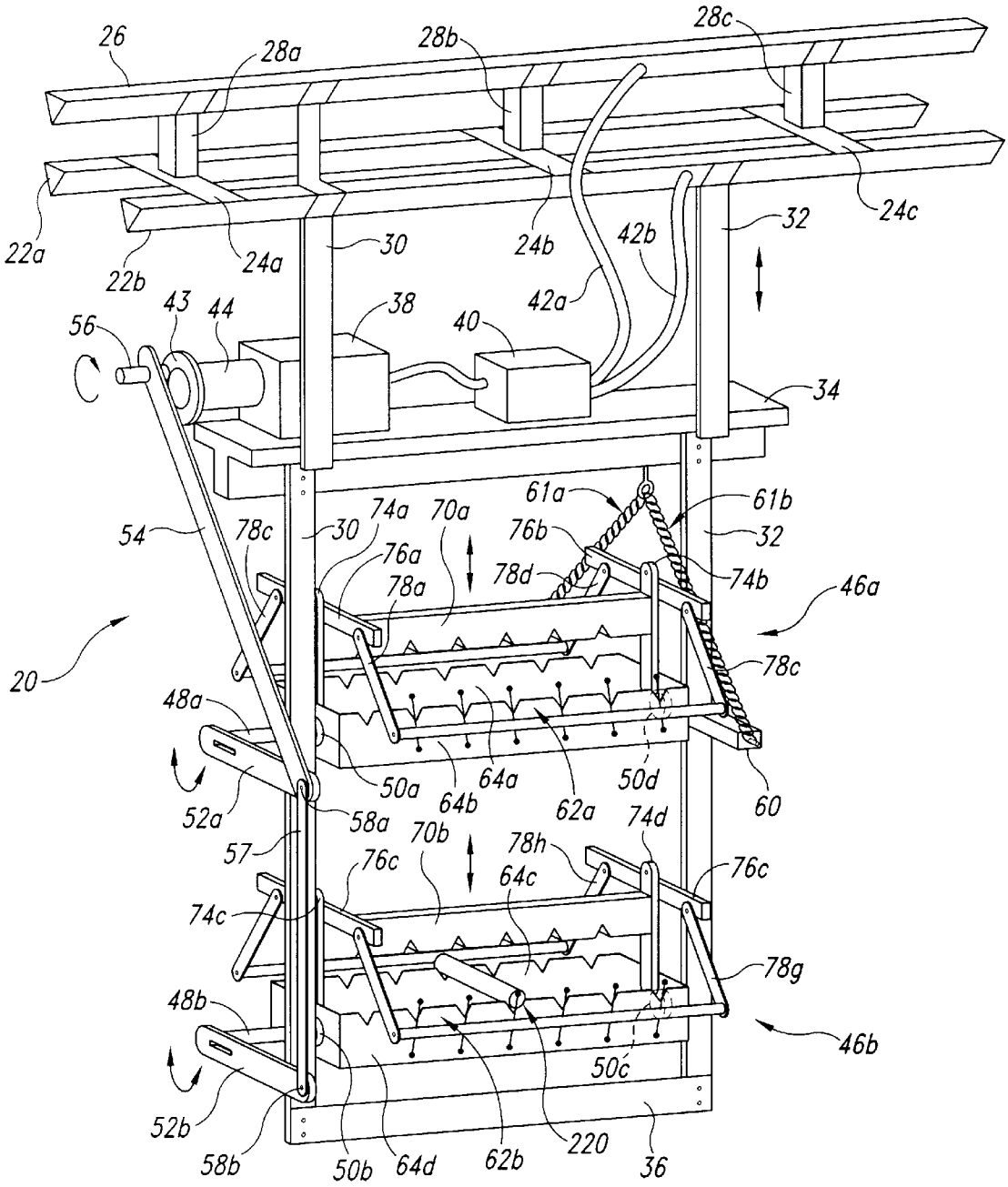
FIG. 4 is an isometric view of a racking fixture for electrochemical processing as a first embodiment of the present invention.

FIG. 4 refers to a racking fixture 20 for holding components during an electro-chemical processing of the components in a first embodiment of the present invention. The racking fixture 20 includes a motor 38 powered by current-carrying buses which also support the fixture 20 within a plating bath. The motor 38 imparts an oscillatory motion to the racking fixture 20 when the racking fixture 20 is partially immersed, along with the components it supports, within the plating bath. The oscillatory motion removes any gas bubbles trapped within blind holes of the components that are positioned on the racking fixture 20.

The racking fixture 20 is supported upon first and second negatively charged current-carrying parallel buses 22*a* and 22*b*, as well as an auxiliary positive current-carrying bus 26, as shown in FIG. 4. Once seated in a tank 100, shown in FIG. 6, both the first parallel bus 22*a* and the second parallel bus 22*b* are connected to a main auxiliary rectifier 102, which is capable of producing up to 500 amps. Support cross members 24*a*–24*c* keep the first and second current-carrying buses 22*a* and 22*b* parallel, while insulating members 28*a*–28*c* separate the support cross members 24*a*–24*c* from the auxiliary positive current-carrying bus 26.

A positive parallel support member 30 is electrically and mechanically coupled to the auxiliary positive current-carrying bus 26 and extends downward at a 90° angle therefrom. A negative parallel support member 32 is electrically and mechanically coupled to the negative current-carrying parallel bus 22*b*, and extends downward 90° therefrom. The negative support member 32 is positioned parallel to the positive parallel support member 30. A T-shaped platform 34 and a spacing member 36 are mechanically coupled at opposite ends of and between the positive parallel support member 30 and the negative parallel support member 32. The T-shaped platform 34 and the spacing member 36 keep the support members 30 and 32 parallel to one another. The T-shaped platform 34 and the spacing member 36 are each made of a nonconductive, corrosion-resistant plastic, which is capable of withstanding temperatures of up to 400° F.

The motor 38, preferably a 3 volt motor, is mechanically fastened to the T-shaped platform 34 and is electrically connected to the negative current-carrying parallel bus 22*b* and the auxiliary positive carrying current-carrying bus 26 via a circuit breaker 40 and electrical leads 42*a* and 42*b*. A drive shaft of the motor 38 is mechanically coupled via a clutch 44 to a cam 43. The clutch 44 may be triggered by a local or remote switch, as is well known in the art.

The racking fixture 20 has first and second semi-rotatable shelves 46*a* and 46*b*, respectively. However, the present embodiment could easily be modified to accommodate more than two semi-rotatable shelves. The semi-rotatable shelves 46*a* and 46*b* have rocking members 48*a* and 48*b*, each semi-rotatable about its axis and supported by the positive and negative parallel support members 30 and 32 via bearing braces 50*a*–50*d*, respectively, at both ends. One end of each of the rocking members 48*a* and 48*b* is also coupled to a respective one of first and second fixed braces 52*a* and 52*b*.

The cam 43 of the motor 38 is mechanically coupled to one end of a first arm 54 via a cam pin 56. The other end of the first arm 54 is coupled to a distal end of the first fixed brace 52*a* via pin 58*a*. A second arm 57 is coupled at one end to the fixed brace 52*a* and, at the other end, to the fixed brace 52*b* via pins 58*a* and 58*b*, respectively.

To ensure that the shelf 46*a* returns to a neutral position once the clutch 44 is disengaged, the first rocking member 48*a* is coupled at one end to a central portion of a horizontal stabilizer 60. Each end of the horizontal stabilizer is coupled to a point on the T-shaped platform 34 via springs 61*a* and 61*b*.

The components 220 to be electroplated and having blind holes 222*a* and 222*b*, are supported on first and second part supports 62*a* and 62*b*. Each of the part supports 62*a* and 62*b* has respective pair of parallel lower notched members 64*a*, 64*b*, 64*c*, and 64*d*. All metal portions of the racking fixture 20 are coated with a nonconductive fuel cell primer to minimize contact and corrosive effect of the cyanide on the metal, preferably stainless steel, and to minimize electrical losses along the rack except at desired portions. Once such desired portion where the metal is exposed and not covered by the coating are notches 66 in each of the notched members 64*a*–64*d*. Each of the notches 66 is stripped clean and designed to make electrical contact with the surface of a respective one of the components 220.

The pairs of lower notched parallel members 62*a*, 62*b*, 62*c*, and 64*d* are slidingly coupled to their respective first and second rocking members 48*a* and 48*b*. Further, stands 74*a*–74*d* are affixed to an upper portion of the first and second rocking members 48*a* and 48*b* to support respective first and second upper notched members 70*a* and 70*b*. The upper notched members 70*a* and 70*b* are slidably engageable to the respective stands 74*a*, 74*b*, 74*c*, and 74*d*. Thus, the first and second part supports 62*a* and 62*b* can be moved to the appropriate position to hold the component 220 in place and allow firm physical as well as electrical contact with the upper notched members 70*a* and 70*b*. The notched members 70*a* and 70*b* are electrically coupled to the negatively charged parallel support member 32.

The fixed braces 52*a* and 52*b* and the bearing supports 50*b* and 50*d* are made of an insulating plastic and any electrical contact is only made to the negatively charged parallel supporting member 32 and not to the positively charged positive parallel supporting member 30, including the respective stands 74*a*, 74*b*, 74*c* and 74*d*.

Each of the semi-rotatable shelves 46*a* and 46*b* extend from the first and second respective rocking members 48*a* and 48*b*. At one end of the stands 74*a*–74*d*, a respective first appendage 76*a*–76*d* is rotatably coupled at its center to a respective one of the stands 74*a*–74*d*. Each end of the first appendages 76*a*–76*d* is rotatably coupled to a respective second appendage 78*a*–78*h*. First through fourth anode racks 80*a*–80*d* are rotatably held between two parallel respective second appendages 78*a*–78*h*, as shown in FIG. 4.

Figure 5A:
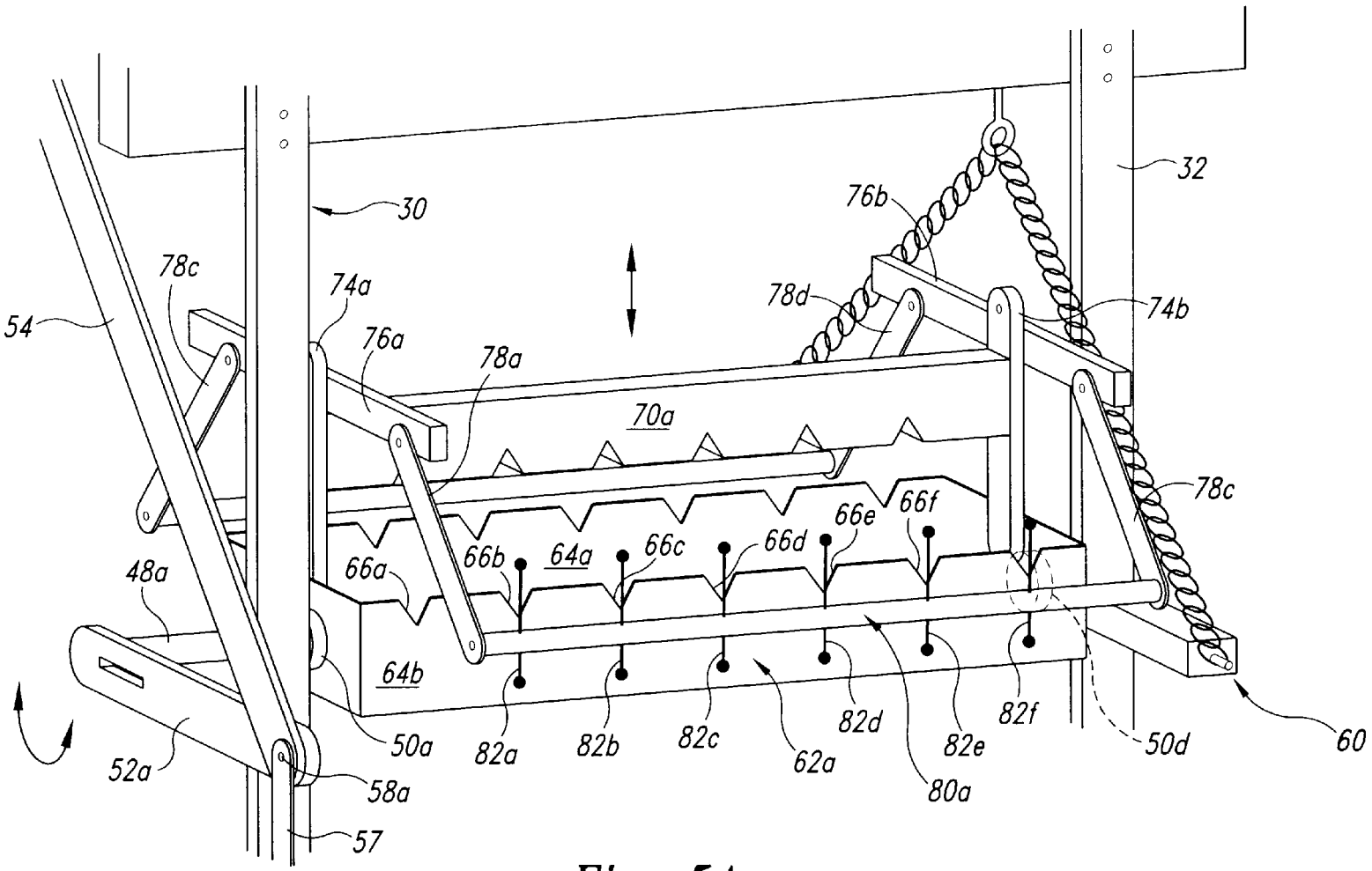
FIG. 5*a* is an isometric view of a first semi-rotatable shelf and two anode racks of the racking fixture.

Each of the anode racks 80*a*–80*d*, such as the first anode rack 80*a*, contains anodes 82*a*–82*f* as shown in FIG. 5A. Each of the anodes 82*a*–82*f* is slidably removable from the anode racks 80*a*, so that the anodes 82*a*–82*f* may be maneuvered, swapped out, or removed. For example, when the component 220 being copper plated, the copper is in the cyanide solution and not on the anode. Therefore, when switching from cadmium plating to copper plating, each of the anodes 82*a*–82*f* is made of stainless steel. However, if the component is to be plated with cadmium, the stainless steel anodes would be replaced by cadmium anodes.

Figure 5B:
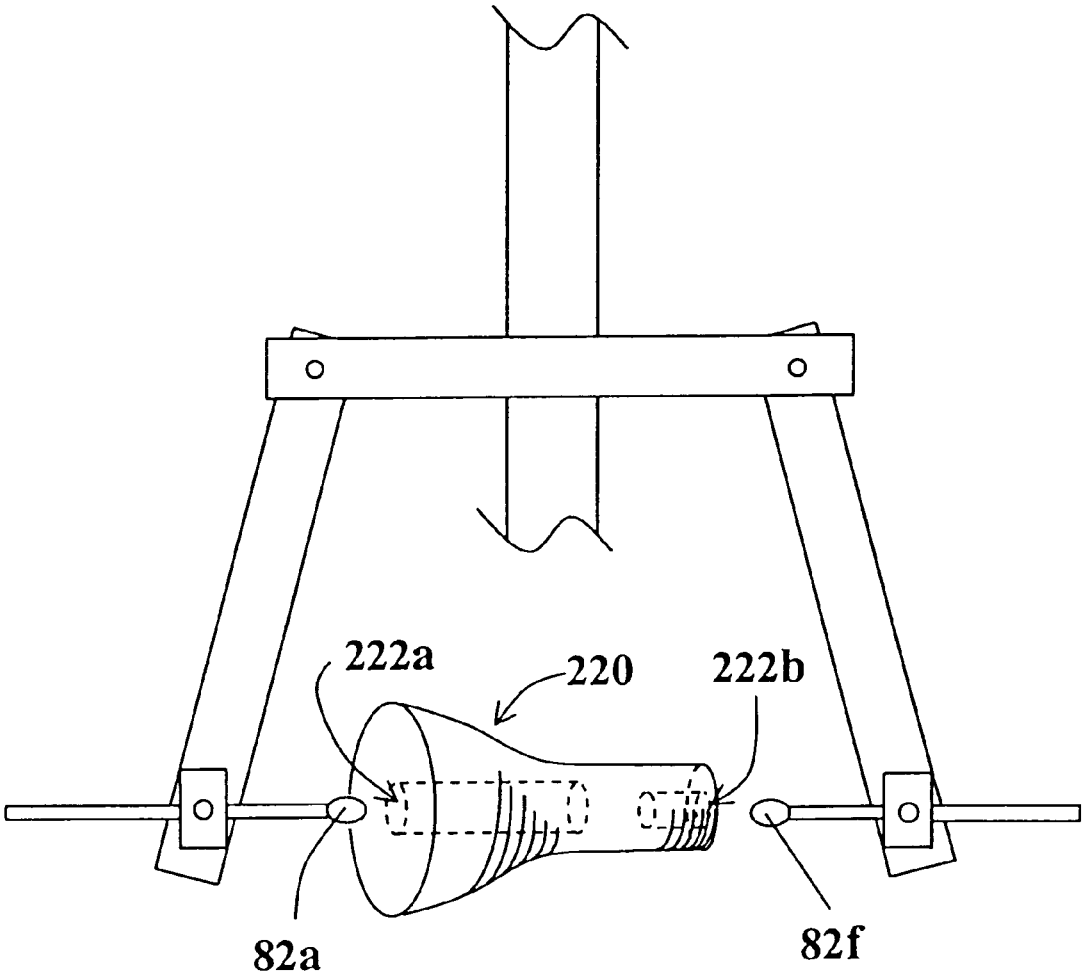
FIG. 5*b* is a side view of an anode and a component held by the racking fixture.
Figure 6:
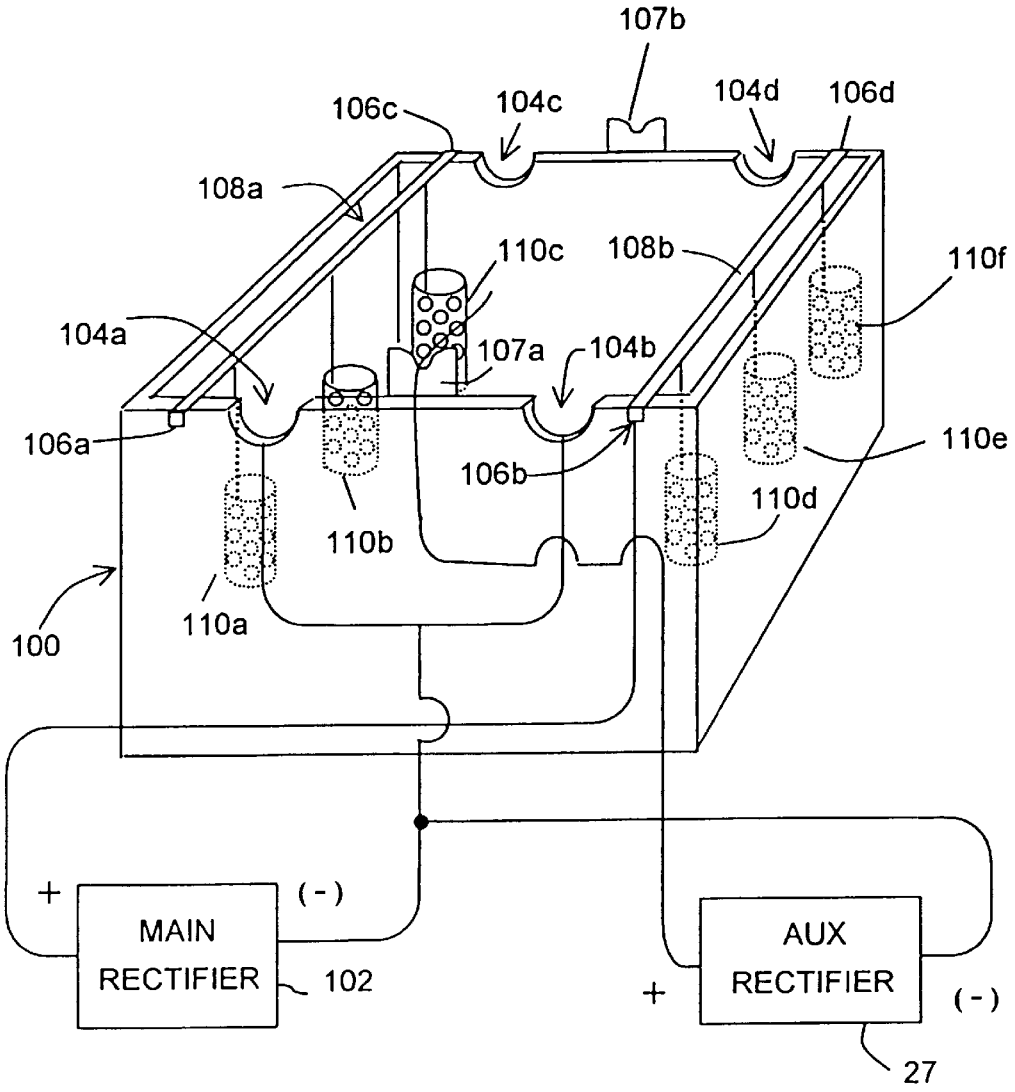
FIG. 6 is an isometric view of a tank for supporting the racking fixture of the present invention.

As shown in FIGS. 4 and 6, the anode racks 80*a*–80*d* are electrically coupled to the positive parallel supporting member 30, which is in turn electrically coupled to the auxiliary rectifier 27. The auxiliary rectifier 27 provides a current of 35–40 amps between each of the anodes 82*a* and 82*h* and its respective component 220, i.e. each of the anodes is positioned within the blind hole of the component 220, as shown in FIG. 5B. However, the overall current used to electroplate the outside of the component 220 is approximately 80 to 120 amps. By using two different potentials in this manner, a more uniform electroplating will occur on the component 220. If a higher current were used for the internal anodes 82*a*–82*f* when electroplating in the holes of each of the components 220, an excessive buildup of cadmium or copper would occur relative to the surface coating due to the relative proximities of the electrodes.

Typically, the anodes 82*a*–82*f* are composed of brightened cadmium if the components 220 are under 200 ksi in strength, while the anodes 82*a*–82*f* are composed of titanium cadmium if the components 220 are over 200 ksi in strength.

In an alternative embodiment, lower notched members 64*a*–64*b* can be further divided into a plurality of slidable plates, allowing the fixturing of components having different widths within the same shelf Further flexibility can be obtained by affixing a plurality of stands to the first and second rocking members 48*a* and 48*b* used to slideably engage the upper notched members 70*a* and 70*b*, allowing them to be subdivided in the same manner as the lower notched members.

The racking fixture 20 is operated in the following manner. First, six components 220 are positioned in each of the six notches 66*a*–66*f* of the parallel lower notched members 64*a*–64*d*. The lower notched members are slidably adjusted so that components 220 are firmly seated in the notches 66*a*–66*f* The upper notched members 70*a* and 70*b* are then slid down onto the components 220 and when the upper and lower notches are in electrical contact with the exposed negatively charged portion of the notches 66*a*–66*f*, the upper notched members 70*a* and 70*b* are locked in place on their respective stands 74*a*–74*d*. Each of the anodes 82*a*–82*f* is slid back and then the respective anode racks 80*a*–80*d* are rotated so that the anodes 80*a*–d may be inserted, or positioned adjacent to each of the holes 222*a* and 222*b* of the components 220, as shown in FIG. 5B.

Once the above operations are performed for the first semi-rotatable shelf 46*a* and the second semi-rotatable shelf 46*b*, the racking fixture 20 is immersed in a series of tanks for pre-treating the components 220. Once the components 220 are ready for electroplating with a substance, such as bright cadmium, the racking fixture 20 is immersed in tank 100 containing cyanide, shown in FIG. 6. The tank 100 includes a 1000-amp main rectifier 102, which is coupled to negative terminal contacts 104*a*–104*d* and positive terminal contacts 106*a*–106*d*. The auxiliary rectifier 27 is coupled to at least two of the negative terminal contacts 104*a*–104*d* and auxiliary positive contacts 107*a* and 107*b*.

The racking fixture 20 is seated in the tank 100 such that the negative current carrying parallel busses 22*a* and 22*b* make physical and electrical contact with the respective negative terminal contacts 104*a*–104*d*. After the fixture 20 is seated properly, the auxiliary positive current carrying bus 26 makes physical and electrical contact with the auxiliary positive contacts 107*a* and 107*b*, shown in FIG. 6.

When properly seated, the racking fixture 20 will totally immerse components 220 in the cyanide solution while the motor 38 and current breaker 40 remain above the solution.

Extension rods 108*a* and 108*b* holding anode baskets 110*a*–*f* containing cadmium balls are positioned on the positive terminal contacts 106*a*–*d*.

The main rectifier 102 and auxiliary rectifier 27, shown in FIG. 6, are switched on and a potential develops between the components 220 and the anodes 82*a*–82*f*, which have been placed in the holes 222*a* and 222*b* of the components 220, as shown in FIG. 5B. A potential is also developed between the anode baskets 110*a*–*f* and the outer surface of the components 220. Since the auxiliary rectifier 27 produces half the amperage of the cadmium baskets 110*a*–*f*, the close proximity of the anodes 82*a*–82*f* is compensated for and a controlled migration of cadmium between the anode and the inside surface of the holes of components 220 begins. After some time, cadmium migration from the balls in baskets 110*a*–*f* evenly coats the outside surface of components 220.

Hydrogen and oxygen bubbles inside the holes of components 220 may impede an even coating within the hole. Therefore, the circuit breaker 40 is switched on, allowing current from the auxiliary bus bar 26 and the negative current carrying bus 22*b* to flow to motor 38. The clutch 44 is then actuated, allowing the rotation of the cam 43, which in turn moves arms 54 and 57 connected to the fixed braces 52*a*–52*b*, which pivot the rocking members 48*a* and 48*b*, causing the semi-rotatable shelves 46*a* and 46*b* to rock back and forth, effectively "jiggling out" any bubbles and ensuring that the entire inner surfaces of the holes of components 72 are properly plated.

Once finished, the clutch is disengaged, causing the springs 61*a* and 61*b* to return the horizontal stabilizer 60 to a level position and, in turn, the semi-rotatable shelves 46*a* and 46*b* to a horizontal position so that they may be safely lifted up with the racking fixture 20 and removed as finished plated components.

Accordingly, the present invention utilizes power supplied by bus bars to drive a motor, which oscillates components held on a fixture to remove hydrogen and oxygen gas generated during electro-chemical processing that has been trapped within blind holes of the components being treated. Further, the present invention provides low powered localized anodes to ensure that the blind holes are evenly plated.

While the foregoing has been a discussion of a specific embodiment of the present invention, those skilled in the art will appreciate that numerous modifications to the disclosed embodiment may be made without departing from the spirit and scope of the present invention. Accordingly, the invention is limited only the following claims.

What is claimed is:

1. A racking fixture for holding components while they are electro-chemically processed comprising:

a plurality of bus bars for supplying electrical current to said components while they are electro-chemically processed;

a shelf for holding the components and electrically connected to at least one of said plurality of bus bars; and a drive assembly electrically powered by said plurality of bus bars and mechanically engaged with said shelf to agitate said shelf to remove gases trapped in said component.

2. The racking fixture according to claim 1 further comprising localized anode assembly electrically connected to at least one of said bus bars and physically connected to said shelf for positioning adjacent specific portions of said component.

3. The racking fixture according to claim 2 wherein said plurality of bus bars includes a first and a second negatively charged bus bar; and a positively charged auxiliary bus bar.

4. The racking fixture according to claim 3, further including:

a positive support member physically and electrically coupled to one of said first and second negatively charged bus bars.

5. The racking fixture according to claim 4 wherein said positive support member and said negative support member are substantially parallel.

6. The racking fixture according to claim 5 wherein said shelf for holding the components includes:

a rocking member supported by said positive support member and said negative support member.

7. The racking fixture according to claim 6 wherein said rocking member is in direct electrical contact with said negative support member, and said rocking member is insulated from said positive support member by an insulating bearing brace.

8. The racking fixture according to claim 7 wherein said shelf further includes at least one lower notched member slidably engaged to said rocking member and electrically connected to said negative support member via raid rocking member, said lower notched member has a plurality of lower notches.

9. The racking fixture according to claim 8 wherein said shelf further includes:

a plurality of stands coupled to said rocking member; and at least one upper notched member slidingly engaged with said stands to move toward or away from said lower notched members, wherein said lower notched member has a plurality of upper notches, and wherein a component is held between said lower notches and said upper notches.

10. The racking fixture according to claim 9 wherein said plurality of bus bars, said positive and negative support members, said rocking members, and said upper and lower notched members are comprised of stainless steel.

11. The racking fixture according to claim 10 wherein said stainless steel is coated with a non-conductive paint at all points except where electrical connections are made and within said lower and upper notches.

12. The racking fixture according to claim 9 wherein said anode assembly includes:

a movable rack parallel to said rocking member and electrically coupled to said positive support member; and a plurality of anodes positioned at intervals along said movable rack and perpendicular to said rocking member.

13. The racking fixture according to claim 6 further comprising a T-shaped platform physically coupled between said positive and negative support member at an end closest to said bus bars; and a spacing member physically coupled between said positive and negative support member at an end opposite said end closest to said bus bars, wherein said T-shaped platform and said spacing member keep said positive and negative support member substantially parallel to one another.

14. The racking fixture according to claim 13 wherein said T-shaped platform and said spacing member include non-conductive, corrosion resistant plastic.

15. The racking fixture of claim 13 further comprising:

a horizontal stabilizer to dampen motion of said shelf, said horizontal stabilizer including:

a horizontal member perpendicular to one end of said rocking member; and a pair of springs, each coupled at one end to said T-shaped platform, each of said other ends of said springs being coupled to a respective end of said horizontal member.

16. The racking fixture according to claim 6, wherein said assembly includes:

an electric motor electrically connected to said positively charged auxiliary bus bar and one of said first and second negatively charged bus bars.

17. The racking fixture according to claim 16, wherein said drive assembly further includes:

a clutch coupled to a drive shaft of said electric motors;

a cam coupled to said clutch; and linkage connected at one end to said cam at an opposite end to said rocking member.

18. The racking fixture according to claim 17 wherein said linkage includes:

a first arm having an end coupled to said cam;

a second arm having one end coupled at to and opposite end of said first arm via a pin, wherein an opposite end of said second arm is coupled to said rocking member.

19. The racking fixture according to claim 18 wherein said anodes comprise at least one of a cadmium anode and a stainless steel anode.

* * * * *